US008312564B2

(12) United States Patent
Beshlian

(10) Patent No.: US 8,312,564 B2
(45) Date of Patent: Nov. 20, 2012

(54) PROTECTIVE GARMENT

(76) Inventor: Kevin Michael Beshlian, Seattle, WA (US)

( * ) Notice: Subject to any disclaimer, the term of this patent is extended or adjusted under 35 U.S.C. 154(b) by 0 days.

(21) Appl. No.: 13/208,245

(22) Filed: Aug. 11, 2011

(65) Prior Publication Data

US 2011/0289644 A1 Dec. 1, 2011

Related U.S. Application Data

(63) Continuation-in-part of application No. 12/404,960, filed on Mar. 16, 2009, now abandoned.

(60) Provisional application No. 61/093,944, filed on Sep. 3, 2008.

(51) Int. Cl.
*A41D 13/00* (2006.01)
*A41D 27/12* (2006.01)

(52) U.S. Cl. ..... 2/46; 2/51; 2/69

(58) Field of Classification Search ..... 2/46, 48, 2/51, 52, 69, 114, 118–122, 125, 126, 243.1, 2/85, 87, 93, 95, 97, 106, 107, 75, 108
See application file for complete search history.

(56) References Cited

U.S. PATENT DOCUMENTS 494,656 A * 4/1893 Teel ..... 2/120
1,075,010 A * 10/1913 Casebolt ..... 2/126
1,257,210 A 1/1918 Clark
1,564,897 A * 12/1925 Sanborn ..... 2/48
1,609,332 A 7/1926 Van Nest
1,647,385 A 11/1927 Voorsanger
1,731,137 A * 10/1929 Jones ..... 2/74
2,212,719 A * 8/1940 Prouty ..... 2/93
2,262,010 A 11/1941 Kuehne
2,420,091 A * 5/1947 Nordling ..... 2/51
2,556,039 A * 6/1951 Landert ..... 2/106
2,922,164 A 1/1960 Liff
3,024,466 A * 3/1962 Agostini ..... 2/48
3,609,767 A * 10/1971 Grosz ..... 2/114
4,553,539 A 11/1985 Morris
4,754,500 A 7/1988 Brucato et al.
4,829,602 A * 5/1989 Harreld et al. ..... 2/51
4,980,927 A 1/1991 Wawiluk et al.
5,010,593 A 4/1991 Stevens, Jr.

(Continued)

FOREIGN PATENT DOCUMENTS

FR 2604610 4/1988

(Continued)

OTHER PUBLICATIONS

Notification of Transmittal of the International Search Report and the Written Opinion of the International Searching Authority issued Apr. 24, 2010 in International Application No. PCT/US2009/055586.

(Continued)

*Primary Examiner* — Amy Vanatta
(74) *Attorney, Agent, or Firm* — Yury M. Colton; Stoel Rives LLP

(57) ABSTRACT

A protective garment including one or more removable layers and/or removable panels attached to a foundation garment. The removable layers or removable panels may be removed by a user if the protective garment is soiled or exposed to a contaminant. In this way, a removable layer or a removable panel may be removed and discarded by the user without needing to remove the entire protective garment.

6 Claims, 7 Drawing Sheets

U.S. PATENT DOCUMENTS

| | | | | |
|---|---|---|---|---|
| 5,454,119 | A * | 10/1995 | Thomm | 2/114 |
| 5,586,339 | A | 12/1996 | Lathan | |
| 5,640,715 | A | 6/1997 | Adams | |
| 5,732,414 | A | 3/1998 | Monica | |
| 5,799,330 | A * | 9/1998 | O'Donoghue-Kitt | 2/114 |
| 5,911,311 | A | 6/1999 | Hutchins | |
| 5,979,722 | A | 11/1999 | Gonzales | |
| 6,105,171 | A | 8/2000 | Niedermeyer | |
| 6,148,442 | A | 11/2000 | Porter | |
| 6,216,269 | B1 | 4/2001 | Smith et al. | |
| 6,408,439 | B1 | 6/2002 | Garforth-Crippen | |
| 6,742,522 | B1 | 6/2004 | Baker et al. | |
| 6,868,558 | B2 | 3/2005 | Majerfeld | |
| 7,971,274 | B2 * | 7/2011 | Graneto, III | 2/114 |
| 2002/0138892 | A1 * | 10/2002 | Drake | 2/51 |
| 2003/0221236 | A1 | 12/2003 | Hippensteel | |
| 2003/0233701 | A1 | 12/2003 | Martz | |
| 2004/0025220 | A1 | 2/2004 | Palmer | |
| 2004/0143220 | A1 | 7/2004 | Worthley | |
| 2005/0235394 | A1 | 10/2005 | Pew | |
| 2006/0048260 | A1 | 3/2006 | Najarian | |
| 2006/0090237 | A1 | 5/2006 | Dabney et al. | |
| 2007/0028343 | A1 * | 2/2007 | Makowka | 2/48 |
| 2007/0061938 | A1 | 3/2007 | Reimer | |
| 2007/0245450 | A1 | 10/2007 | Feodoroff | |
| 2007/0250979 | A1 | 11/2007 | Han | |
| 2008/0092265 | A1 | 4/2008 | Gage et al. | |
| 2010/0064407 | A1 | 3/2010 | Beshlian | |
| 2010/0105283 | A1 * | 4/2010 | Trenhaile | 450/31 |
| 2010/0212063 | A1 * | 8/2010 | Baucom et al. | 2/114 |

FOREIGN PATENT DOCUMENTS

| | | |
|---|---|---|
| JP | 2004-332154 | 11/2004 |
| WO | WO 2010/027958 | 3/2010 |

OTHER PUBLICATIONS

Notification Concerning Transmittal of International Preliminary Report on Patentability issued Mar. 17, 2011 in International Application No. PCT/US2009/055586.

* cited by examiner

PROTECTIVE GARMENT

This application is a continuation-in-part of U.S. application Ser. No. 12/404,960, filed on Mar. 16, 2009, which claims the benefit of U.S. Provisional Application No. 61/093,944, filed Sep. 3, 2008. This application hereby incorporates by reference the U.S. priority applications enumerated herein.

TECHNICAL FIELD

The present disclosure relates to protective clothing. More particularly, this disclosure relates to a wearable protective garment including one or more removable layers and/or removable panels that may allow a user to remove a contaminated or soiled layer or panel without changing the whole garment.

DETAILED DESCRIPTION

Figure 1A:
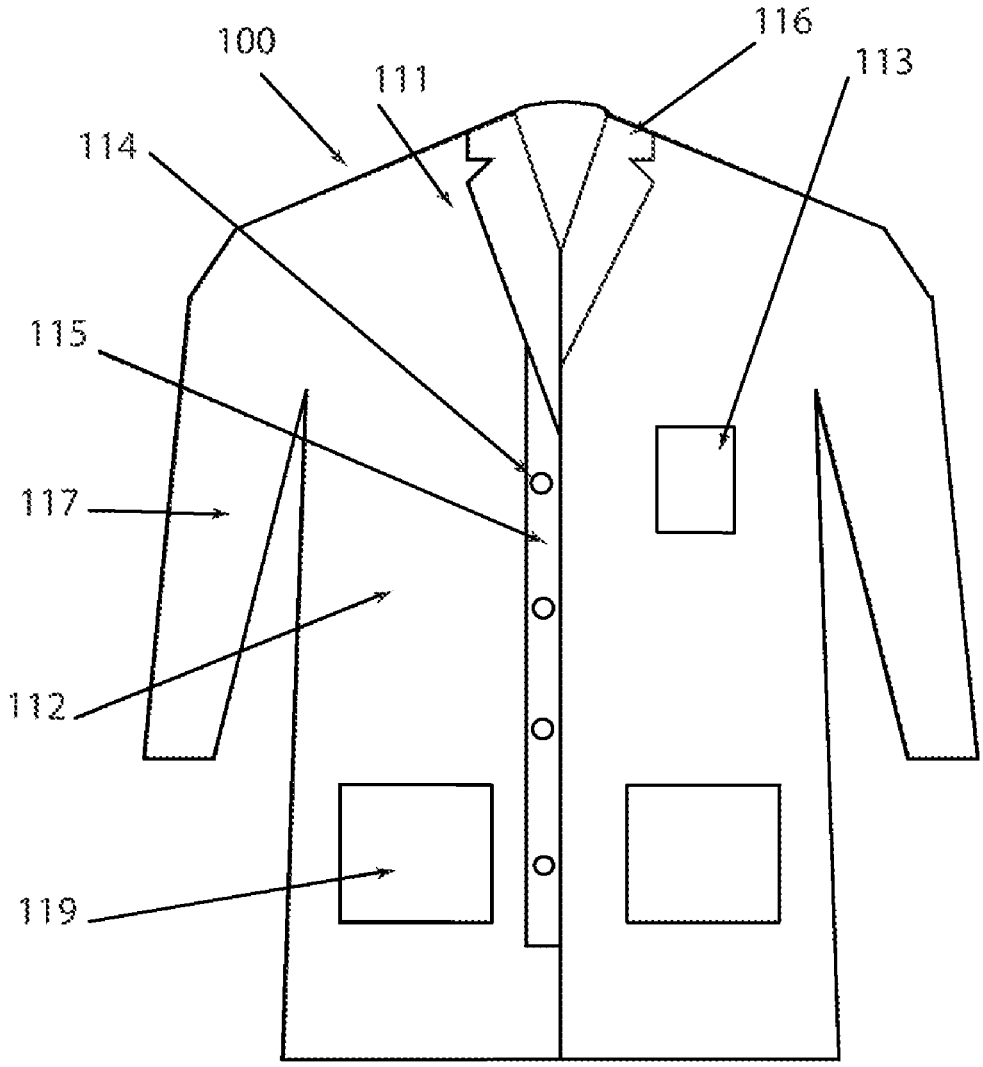
FIG. 1A shows one embodiment of a protective garment.

Laborers and professionals in many industries are exposed to a variety of conditions that may soil or contaminate their clothing. For example, with each patient visit or procedure, health care workers may be exposed to various pathogens and contaminants that can soil and compromise the safety of their clothes. To avoid spreading the contaminants to other individuals or equipment, a worker would usually remove or discard the entire contaminated garment. The present disclosure relates to a protective garment or outerwear with one or more removable layers that may allow the user to remove a contaminated or soiled layer without changing the whole garment.

A protective garment as disclosed herein may be an overcoat, smock, gown or lab coat of the type worn by doctors, scientists, technicians, laboratory workers and other professionals in the medical and health care industries. In one embodiment, the protective garment may include one or more removable layers and/or removable panels that may conform to the shape and fit of at least a portion of a foundation garment. When the wearer of a protective garment as disclosed herein engages in an activity that may soil or contaminate one or more of the removable layers of the protective garment, the wearer may remove one or more removable panels from the protective garment and place them in the recycling, trash or laundry. In another embodiment, the protective garment may be a butcher's coat or other protective clothing, coat, pants, coveralls, lab coat, apron, chaps or covers that may be used for industrial applications or in food preparation and processing. In one such embodiment, the protective garment disclosed herein may be used for general maintenance, painting, lead or asbestos cleanup, mold remediation, chemical application, pesticide/herbicide applications, radioactive cleanup, construction, automotive work, fiberglass installation, agriculture, environmental cleanup, sand blasting, forensics, woodworking, mining or cross-contamination prevention.

The protective garment, including the removable layers and/or removable panels, can be constructed from one or more natural or synthetic materials. In one embodiment, the removable panels of the protective garment may be constructed from a lightweight and breathable material. In one embodiment, the protective garment may be constructed from one or more of cotton, cotton/polyester blend, polyester and nylon. In another embodiment, the protective garment can be constructed from one or more washable, disposable or recyclable materials such as paper, plastic, vinyl, polypropylene or polyethylene.

In one embodiment, the protective garment may include a foundation garment made of one material and one or more removable layers or removable panels constructed of the same or a different material. For example, a protective garment as disclosed herein may include a cotton and/or polyester foundation garment with multiple removable panels covering at least a portion of the foundation garment, wherein the removable panels may be constructed from paper, plastic, vinyl, polypropylene, polyethylene or any other suitable woven or non-woven material.

A protective garment as disclosed herein may be constructed of one or more materials selected according to the expected working conditions or a particular desired performance characteristic. In one embodiment, depending on the expected risk of chemical or fluid contamination, the foundation garment and/or one or more of the removable panels can be constructed of lightweight sheer spun-bonded polypropylene. In another embodiment, where the risk of fluid contamination may be significant, one or more of the removable panels can be constructed from a water-repellent material such as a flash-spun high-density polyethylene, like Tyvek®, or polypropylene coated with polyethylene or breathable micro-porous polypropylene. In yet another embodiment, the foundation garment and/or one or more removable layers or removable panels can include materials that incorporate antimicrobial agents or that have been treated with antimicrobial agents. For example, the foundation garment and/or one or more of the removable panels may be treated with, or include, an antimicrobial agent such as iodine, chlorine, silver oxide or silver nanoparticles.

In one embodiment, a protective garment as disclosed herein may include one or more removable layers that can be attached to a foundation garment. In one such embodiment, the one or more removable layers may be configured to include one or more removable panels, such that the one or more removable panels are independently removable from each other. For example, a removable layer having a removable front panel and a removable sleeve panel would allow for the removal of the front panel to be separate and independent from the removal of the sleeve panel.

In one embodiment of a protective garment, one or more removable panels can be mechanically attached to the foundation garment using methods such as, but not limited to, hook and loop fasteners, stitches, buttons, snaps, hook and eye fasteners, staples, or zippers. In another embodiment, one or more removable panels may be attached to a foundation garment using a suitable adhesive, such as a low-tack adhesive, adhesive film or tape. In yet another embodiment, one or more removable panels can be sewn or stitched onto the foundation garment. For example, one or more removable layers can be sewn or stitched onto the foundation garment along the seams or edges of the foundation garment. In still another embodiment, a protective garment as disclosed herein may include one or more removable panels on a foundation garment in which the one or more removable panels may comprise pre-cut perforations to allow a user to remove one or more removable panels as desired.

In one embodiment, a protective garment as disclosed herein may include one or more removable panels disposed on a foundation garment that has been configured as a lab coat. In one such embodiment, the foundation garment may comprise a back, front, chest pocket or pockets, waist pockets, front closures, sleeves and a collar with lapels. The foundation garment may be constructed, for example, using one of, or a combination of, cotton, cotton/polyester blend, polyester, nylon, plastic, vinyl, polyethylene, polypropylene or any other suitable material. In certain such embodiments, one or more removable panels may be configured to substantially conform to the shape of the foundation garment. For example, the removable panels may be configured to conform to the shape of one or more of the back, the front and the sleeves of the foundation garment. In one embodiment, the one or more removable panels can include one or more removable front panels. In another embodiment, the one or more removable panels can include one or more removable sleeve panels. In yet another embodiment, the one or more removable panels can include both one or more removable front panels and one or more removable sleeve panels. The one or more removable front panels and removable sleeve panels may be separately and independently removable. In one embodiment, the one or more removable panels can include pre-cut perforations, or may be scored or sectioned to facilitate the removal of the removable panels from the foundation garment. The one or more removable panels can be perforated along the borders of the removable panels. The one or more removable panels can be attached to the foundation garment by sewing or stitching the edges of the removable panels to the seams or edges of the foundation garment.

A protective garment as disclosed herein may include a frame or support to which one or more removable layers may be attached. The frame may be used to reduce the bulk or weight of the protective garment. In one embodiment, the frame may include shoulder, back and chest pieces. In one such embodiment, the frame or support may be similar to a half-vest and can include an attached collar, lapels and a button strip. The frame or support can be constructed using a durable fabric such as a heavy-weight cotton duck, polyester or nylon. In another embodiment, the frame may be constructed of cotton, cotton/polyester blend, polyester or nylon. In another embodiment, the frame or support may be stiffened using an underlayment material or by using battens stitched into the material. In one embodiment, the frame may also be a semi-rigid structure comprising rods or strips that may be configured to comfortably fit over the wearer's shoulders. The frame can be constructed of nylon, plastic or vinyl and may include attached fabric breast pieces for improved comfort and to support breast pockets as desired. In one embodiment, the removable layers may be attached to the frame using adhesive, low-tack adhesive, adhesive film, tape, stitches, staples or mechanical means such as, but not limited to, hook and loop fasteners, buttons, snaps, hook and eye fasteners, or zippers. In another embodiment, the removable layers may be attached to the frame using slots that engage a piping edge sewn or formed into the removable layers. In still another embodiment, the removable layers attached to the frame may include one or more removable panels that include pre-cut perforations along the borders to facilitate removal thereof.

The protective garment may include a foundation garment that may be constructed as a coat or gown and may include removable layers that may include one or more removable panels. This can allow the wearer to remove one or more of the removable panels that may have been soiled or contaminated during a procedure or process. In one embodiment, the removable panels may be shaped to conform to the shape or a region of the foundation garment. In one embodiment, a protective garment may include removable panels that may be constructed as one or more of a collar/lapel panel, back panel, shoulder panels, breast panels, waist panels, sleeve panels and pant leg panels. In one embodiment, the protective garment may include one or more removable sections that may directly engage or overlap the edges of one or more of any adjacent removable panel. In another embodiment, the protective garment may include one or more removable layers or removable panels that do not engage or overlap any adjacent removable layer or panel.

In one embodiment, the protective garment may be configured as a surgical gown or smock with removable layers covering at least a portion of the protective garment. In one such embodiment, the protective garment may include a foundation garment fashioned like a surgical gown with ties, for example, at the back, waist or neck, and may include removable layers that may cover at least a portion of the protective garment such as the front and sleeves of the garment.

In another embodiment, the protective garment can be constructed as an apron having removable layers. The apron may be worn by a butcher or others in food service or processing. This has the advantage of allowing a food handler to remove a layer any time the apron may become soiled or if the handler, such as a butcher, leaves the processing area to interact with customers. A protective garment with removable layers that are substantially self-adhesive may also be used with the protective garment as described herein. For example, the removable layers may be made from plastic, vinyl and polyethylene products that can have inherently tacky characteristics that may adhere to another removable layer or the foundation garment. For example, spun-bonded polypropylene layers can be combined on a filament level by stacking individual sheets and subjecting the stack or bundle to pressure, causing an engagement to occur between the weave or individual filaments in the material. In one embodiment, the spun-bonded layers can be combined as sheets prior to cutting and placement on the foundation garment or frame. In another embodiment, the removable layers may be mated together and placed on a mandrel before press-bonding the removable layers together. In one embodiment, the individual removable layers may include non-adhered regions or tabs, which can facilitate removal of the individual layers.

A protective garment as disclosed herein may also be configured using multiple layers of dissimilar material designed to perform a specific function or designed around different stages in a procedure. In one embodiment, a protective garment such as a surgeon's gown may include a foundation garment with removable layers staged for steps in the surgery. For example, the topmost removable layer on a surgeon's gown may be a polyethylene-coated polypropylene for waterproof protection, used during the initial stages of an operation, while the next layers may be spun-bonded polypropylene, or another lightweight and comfortable material, used during closing and post-op monitoring.

Figure 1B:
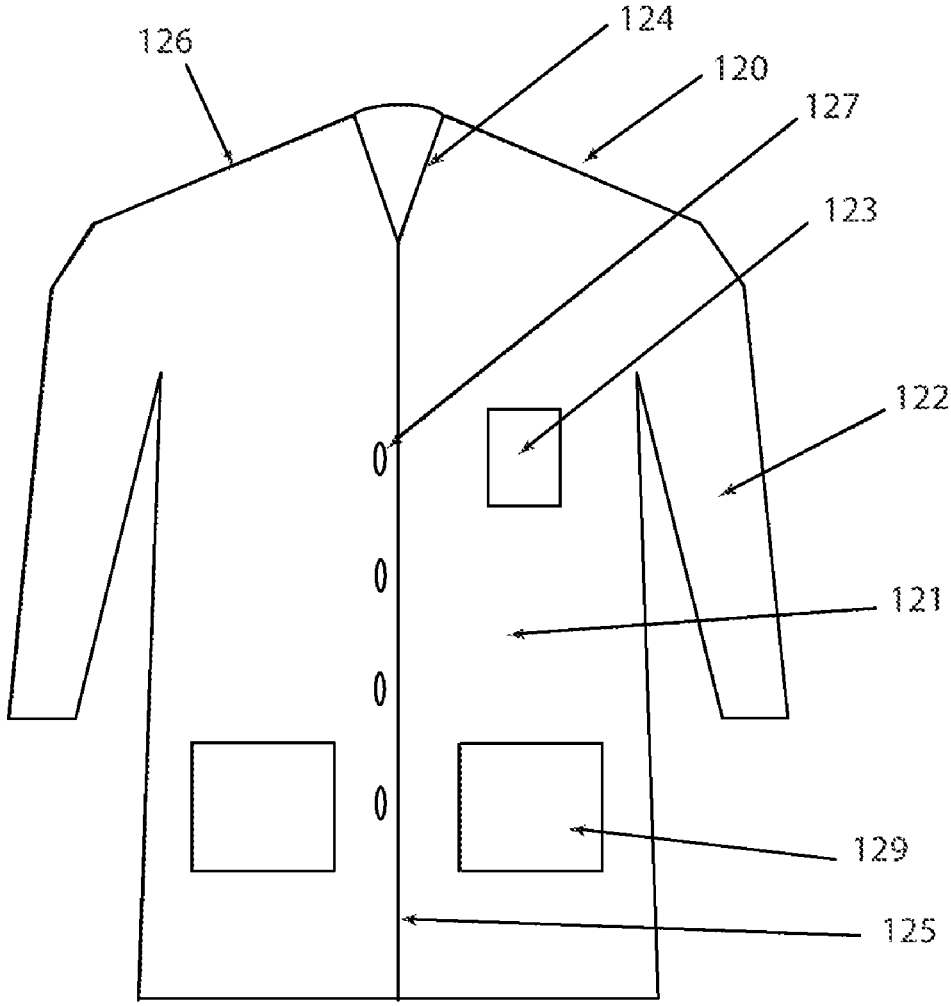
FIG. 1B shows one embodiment of a removable layer for a protective garment.

With reference to the figures, a protective garment, such as protective garment 100 shown in FIGS. 1A-1B may be configured as a lab coat, having a foundation garment 111 and one or more removable layers, such as removable layer 120. In one embodiment, the foundation garment 111 may include a lapel or collar 116, front panels 112, a chest pocket 113, waist pockets 119 and sleeves 117. The foundation garment 111 can be secured closed using a button strip 115, which may include two overlapping portions, the first or bottom portion may include buttons 114, and the second or top portion may include corresponding button holes.

As shown in FIG. 1B, removable layer 120 may include a similar form as the foundation garment 111. In one embodiment, the removable layer 120 may include a collar 124, shoulders 126 and front panels 121. In one embodiment, the removable layer 120 may have sleeves 122 and an internal or external pocket, such as pocket 123 and waist pocket 129. In another embodiment, the removable layer 120 may include an overlapping front opening 125 having button holes 127 that may correspond with the buttons 114 attached to the foundation garment 111. In one such embodiment, the removable layer 120 may be placed on the foundation garment 111, and may be secured to the foundation garment 111 by inserting buttons 114 through button holes 127 or by using any suitable attachment means.

Figure 2A:
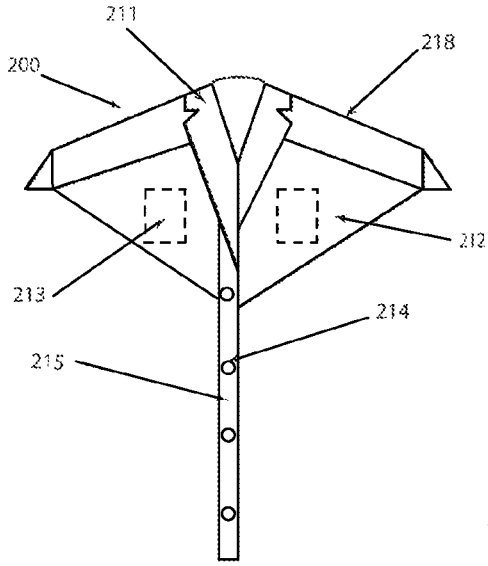
FIG. 2A shows a support frame for one embodiment of a protective garment.
Figure 2C:
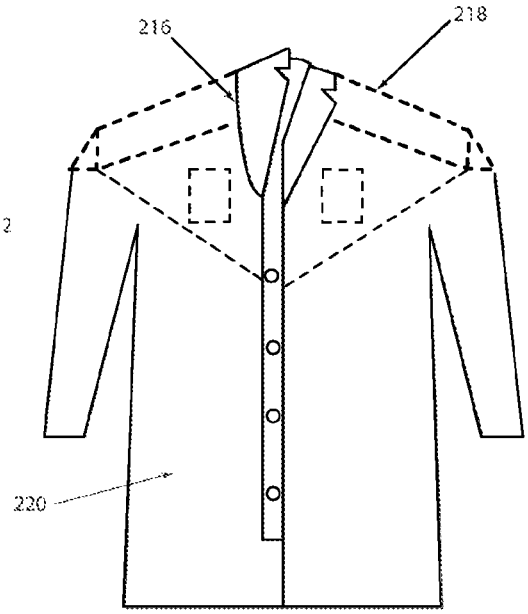
FIG. 2C shows one embodiment of a protective garment and an attached removable layer.
Figure 2B:
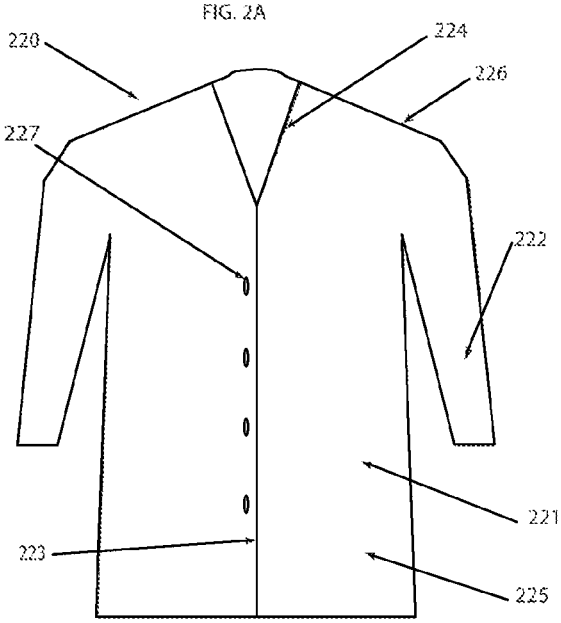
FIG. 2B shows one embodiment of a removable layer for a protective garment.

With reference to FIGS. 2A-2C, one embodiment of a protective garment may include a frame or support, such as frame 200. The frame 200 may include a lapel or collar 211, front panels 212, button strip 215 and shoulder support frames 218. The shoulder support frames 218 may be configured as rods or straps and may be constructed from a material such as plastic, vinyl or nylon. In one embodiment, front panels 212 may be attached to the shoulder support frames 218, to provide improved comfort for the wearer, and support chest pockets 213. In another embodiment, button strip 215 may include two overlapping portions, the first or bottom portion including buttons 214 while the second or top portion includes corresponding button holes (not shown). In one embodiment, one or more removable layers 220, as shown in FIG. 2B, can be placed on the frame 200. Removable layer 220 may comprise a body portion 221 including a neck opening 224, back portion (not shown), front portions 225 with an overlapping front opening 223 having button holes 227 through both layers of front opening 223, shoulders 226 and sleeves 222. In one embodiment, the removable layer 220 may be placed on shoulder support frames 218 with the neck opening 224 positioned under the collar 211. In one such embodiment, the neck opening 224 can be attached or secured under the collar 211 along attachment line 216. In another embodiment, the neck opening 224 can be passively restrained by the collar 211 when the collar 211 is in a down position, as shown in FIG. 2A. In another embodiment, front opening 223 is secured to the lab coat frame 200 by inserting buttons 214 through button holes 227 in the removable layer 220. In one embodiment, the shoulder portion 226 of removable layer 220 is supported by support frames 218.

Figure 3:
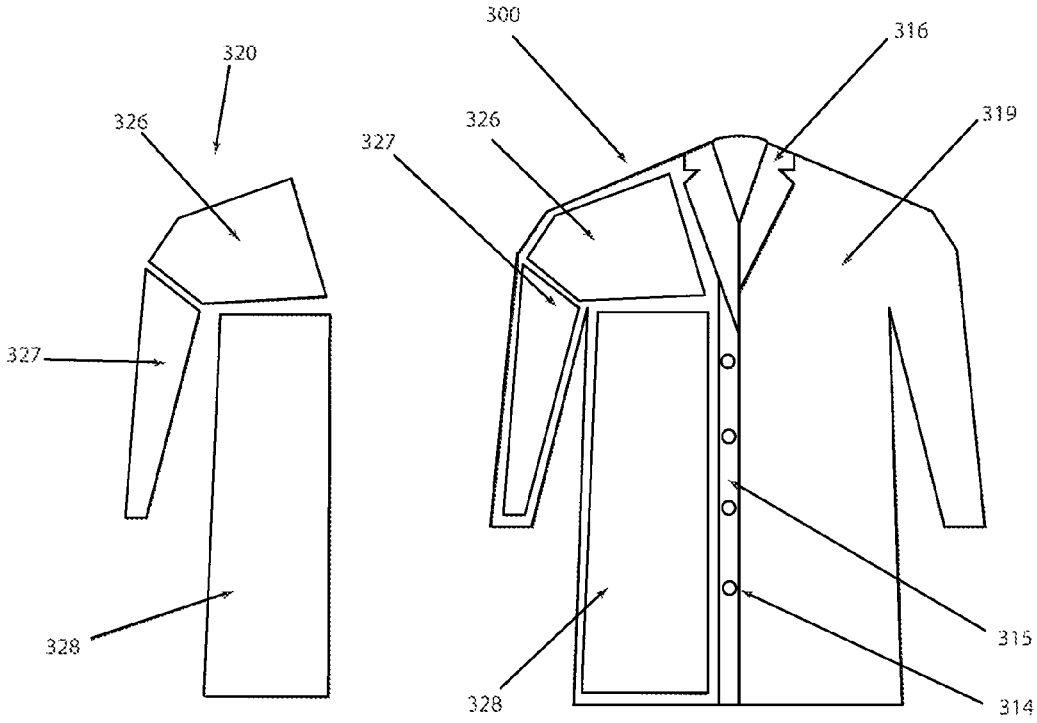
FIG. 3 shows one embodiment of a protective garment including one or more removable panels.

As shown in FIG. 3, protective garment 300 may include a foundation garment comprising a lapel or collar 316, front portions 319, and a closing with buttons 314 attached to button strip 315. In one embodiment, protective garment 300 may be at least partially or substantially covered with one or more removable layers comprising removable panels 320, which may include, but are not limited to, shoulder panels 326, sleeve panels 327 and front panels 328. In one embodiment, the removable panels 320 can be attached using a low-tack adhesive or other attachment means.

Figure 4:
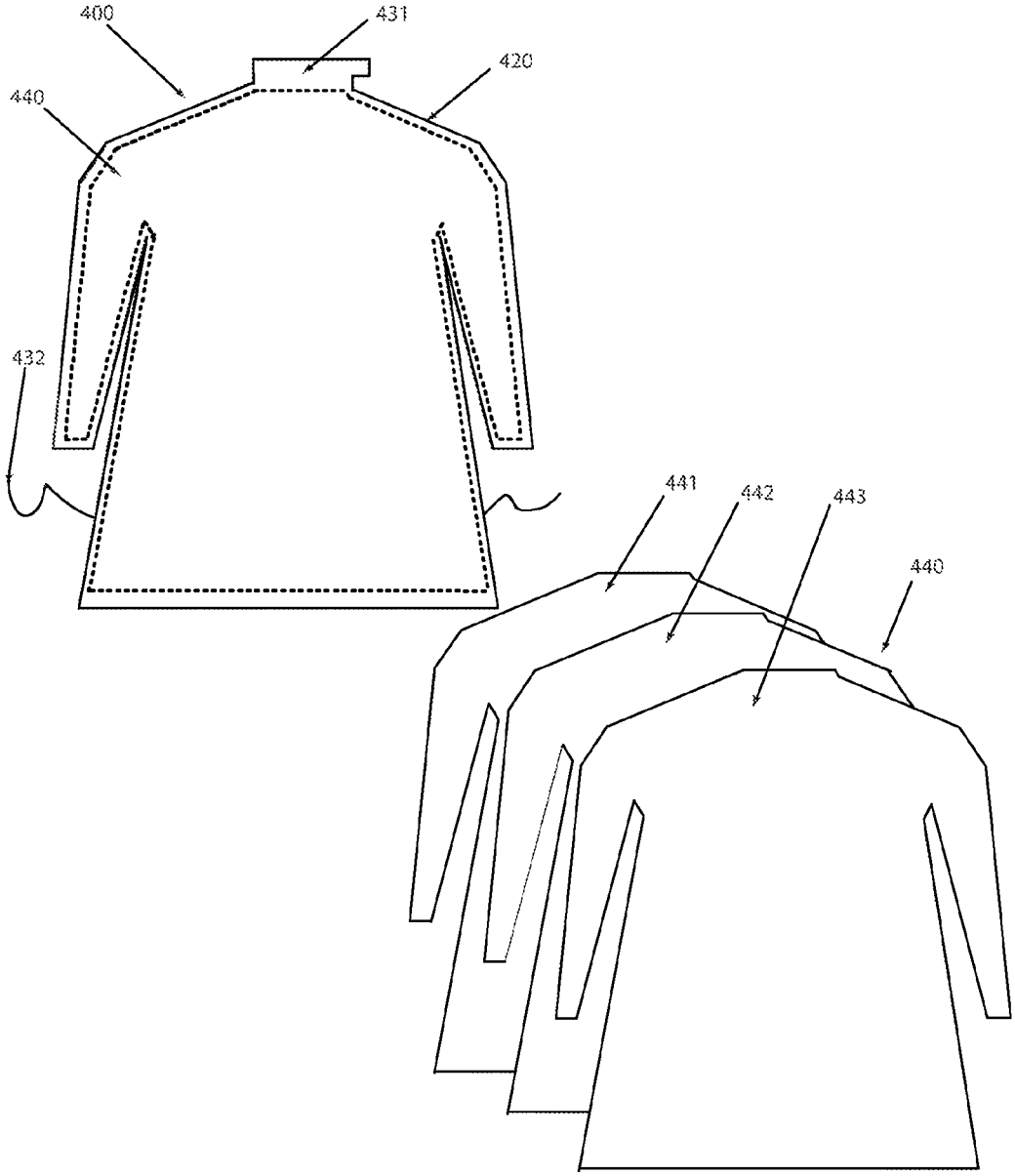
FIG. 4 shows one embodiment of a protective garment including multiple removable layers.

In another embodiment, shown in FIG. 4, a protective garment as disclosed herein may be configured like surgical gown 400. The surgical gown 400 may be a front-, side- or rear-closing gown and can include a collar 431 with ties 432. The surgical gown 400 may comprise one or more removable layers, such as removable layer 440, that can be attached to a foundation gown 420. The removable layer 440 may be attached to the foundation gown 420 by at least one of a hook and loop fastener, hook and eye fasteners, buttons, snaps or zippers. The removable layer 440 may also be attached using a low-tack adhesive or with the inherent adhesive characteristics of the material used for the foundation gown 420 and the removable layer 440. In one embodiment, the removable layer 440 can include multiple layers of similar material or may include multiple layers staged to optimize functionality during different steps of a surgical procedure. For example, as shown in FIG. 4, top layer 443 may be a waterproof vinyl, containing antimicrobial silver oxide, while the removable layers 442 and 441 may be a lighter, more comfortable material, such as breathable microporous polypropylene.

Figure 5A:
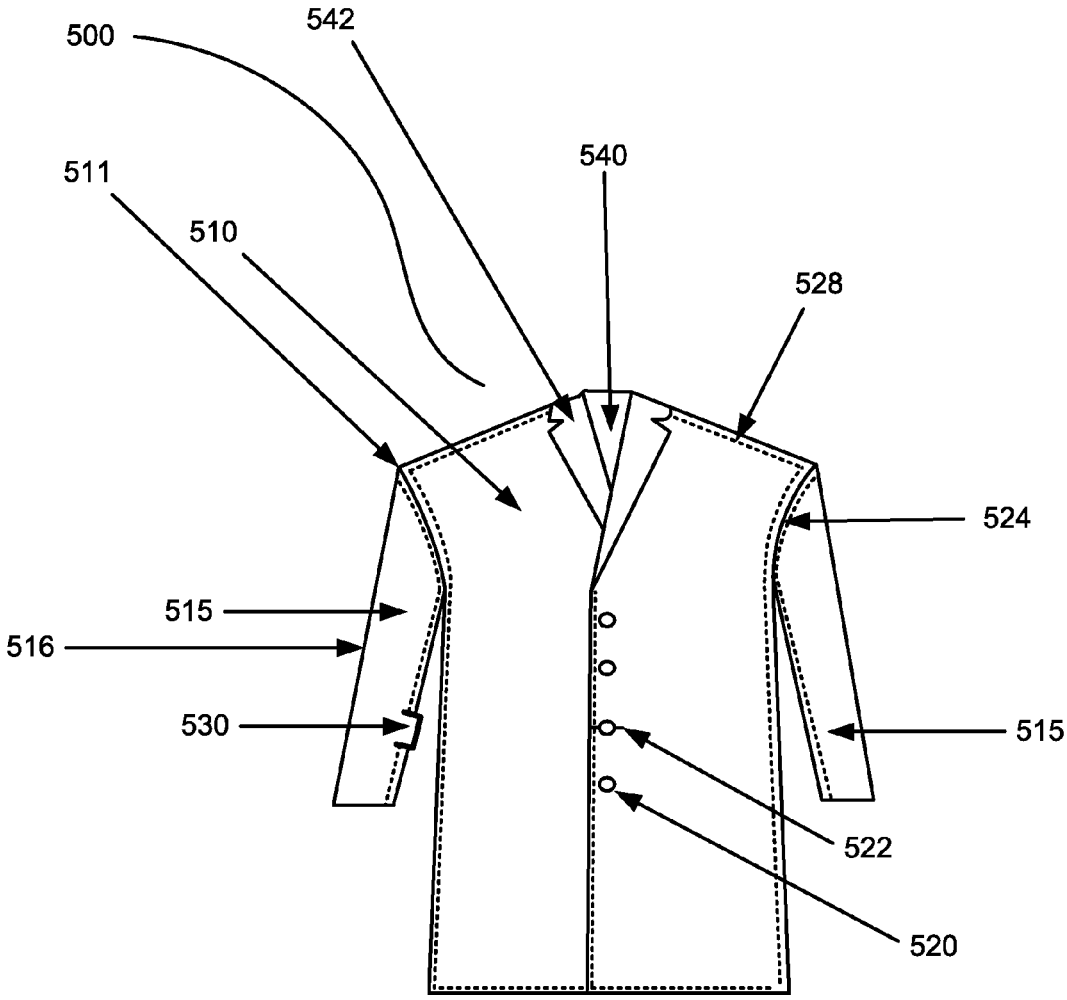
FIG. 5A shows one embodiment of a protective garment including one or more removable panels with pre-cut perforations.
Figure 5B:
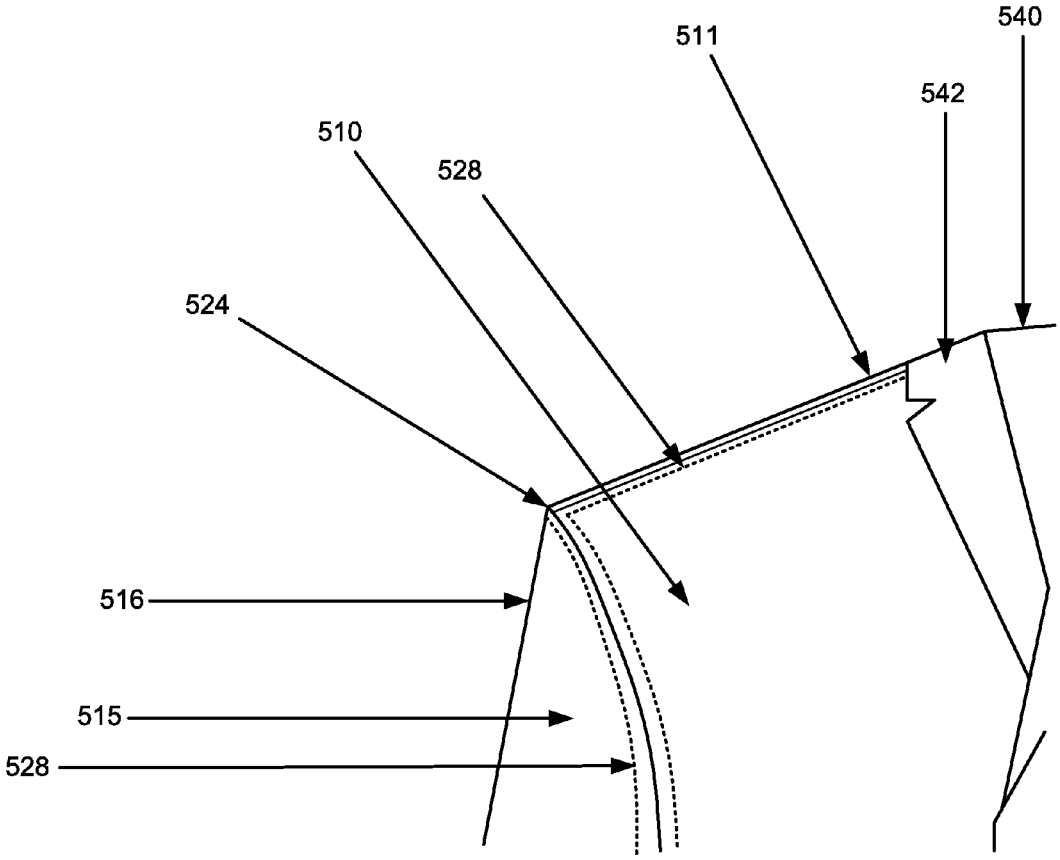
FIG. 5B shows another embodiment of a protective garment comprising one or more removable panels with pre-cut perforations.

As shown in FIGS. 5A-5B, a protective garment 500 may include a foundation garment 540 comprising a lapel or collar 542, front portions 511, one or more sleeve portions 516, and a closing with buttons 520. In one embodiment, the foundation garment 540 may be configured to resemble a lab coat. In one embodiment, the foundation garment 540 may be at least partially or substantially covered with one or more removable panels, including, but not limited to, removable front panels 510 and removable sleeve panels 515. In one embodiment, the removable front panels 510 and removable sleeve panels 515 can be perforated along the borders or edges as shown by perforations 528. The removable panels may be constructed from cotton, cotton/polyester blend, polyester, polypropylene, polyethylene, spun-bonded polypropylene, flash-spun high-density polyethylene, polyethylene-coated polypropylene, microporous polypropylene, rayon, vinyl, plastic or nylon, or other suitable woven or non-woven materials. Each of the removable front panels 510 and removable sleeve panels 515 can include tabs 530, which can facilitate removal of the individual layers along the perforations 528. The one or more removable front panels 510 and removable sleeve panels 515 can be sewn or stitched onto the foundation garment 540 along the seams or edges 524 of the foundation garment 540. Button holes 522 may be cut through the one or more perforated removable front panels 510 to form button holes 522 for the front closure buttons 520.

It will be obvious to those having skill in the art that many changes may be made to the details of the above-described embodiments without departing from the underlying principles of the invention. The scope of the present invention should, therefore, be determined only by the following claims.

The invention claimed is:

1. A protective garment comprising:

a foundation garment comprising a front and at least one sleeve;

at least one removable front panel attached to the foundation garment comprising pre-cut perforations configured to allow removal of the at least one removable front panel; and at least one removable sleeve panel attached to the foundation garment comprising pre-cut perforations configured to allow removal of the at least one removable sleeve panel.

2. The protective garment of claim 1, wherein the foundation garment is made of at least one of cotton, cotton/polyester blend, polyester, polypropylene, polyethylene, spun-bonded polypropylene, flash-spun high-density polyethylene, polyethylene-coated polypropylene, microporous polypropylene, vinyl, plastic and nylon.

3. The protective garment of claim 1, wherein the at least one removable front panel is independently removable from the at least one removable sleeve panel, and wherein the at least one removable sleeve panel is independently removable from the at least one removable front panel.

4. The protective garment of claim 1, wherein the at least one removable front panel is made of at least one of cotton, cotton/polyester blend, polyester, polypropylene, polyethylene, spun-bonded polypropylene, flash-spun high-density polyethylene, polyethylene-coated polypropylene, microporous polypropylene, rayon, vinyl, plastic and nylon.

5. The protective garment of claim 1, wherein the at least one removable sleeve panel is made of at least one of cotton, cotton/polyester blend, polyester, polypropylene, polyethylene, spun-bonded polypropylene, flash-spun high-density polyethylene, polyethylene-coated polypropylene, microporous polypropylene, rayon, vinyl, plastic and nylon.

6. The protective garment of claim 1, wherein the at least one removable front panel and the at least one removable sleeve panel are attached to the foundation garment by at least one of a hook and loop fastener, hook and eye fasteners, snaps, buttons, zippers, stitching, staples and adhesive.

* * * * *